US010858159B2

(12) United States Patent
Lai et al.

(10) Patent No.: US 10,858,159 B2
(45) Date of Patent: Dec. 8, 2020

(54) ROTARY SEALED PACKAGING CONTAINER

(71) Applicants: SHENZHEN BEAUTY STAR CO., LTD, Guangdong (CN); GUANGZHOU BEAUTY STAR CO., LTD, Guangdong (CN)

(72) Inventors: Xiaohua Lai, Guangdong (CN); Debin Yan, Guangdong (CN); Yuanhong Chen, Guangdong (CN); Shenzhou Li, Guangdong (CN)

(73) Assignees: SHENZHEN BEAUTY STAR CO., LTD, Shenzhen (CN); GUANGZHOU BEAUTY STAR CO., LTD, Guangzhou (CN)

( * ) Notice: Subject to any disclaimer, the term of this patent is extended or adjusted under 35 U.S.C. 154(b) by 37 days.

(21) Appl. No.: 16/384,982

(22) Filed: Apr. 16, 2019

(65) Prior Publication Data

US 2020/0331665 A1 Oct. 22, 2020

(51) Int. Cl.

| | |
|---|---|
| ***B65D 47/24*** | (2006.01) |
| ***B65D 47/12*** | (2006.01) |
| ***B65D 41/28*** | (2006.01) |

(52) U.S. Cl.

CPC ..... *B65D 47/242* (2013.01); *B65D 41/28* (2013.01); *B65D 47/127* (2013.01); *B65D 47/244* (2013.01); *B65D 2251/0015* (2013.01); *B65D 2251/0056* (2013.01); *B65D 2251/0075* (2013.01); *B65D 2251/205* (2013.01)

(58) Field of Classification Search

CPC .... B65D 47/242; B65D 41/28; B65D 47/127; B65D 2251/0056; B65D 2251/205; B65D 2251/0015; B65D 2251/0075

See application file for complete search history.

(56) References Cited

U.S. PATENT DOCUMENTS

| | | | | |
|---|---|---|---|---|
| 5,269,426 | A * | 12/1993 | Morano | A61J 11/008 215/11.6 |
| 5,938,086 | A * | 8/1999 | Gross | B65D 47/244 222/494 |
| 2003/0127467 | A1* | 7/2003 | Adams | B65D 51/227 222/153.14 |
| 2005/0236440 | A1* | 10/2005 | Cho | B65D 47/244 222/519 |

* cited by examiner

*Primary Examiner* — James N Smalley

(57) ABSTRACT

The present disclosure belongs to the field of packaging, and provides a rotary sealed packaging container which comprises an outer lid, a hollow inner core and a container body, wherein the inner core is mounted on an opening part of the container body so that the inner core can relatively move in axial direction of the container body and cannot relatively rotate in the circumferential direction, and the outer lid is mounted on the opening part so that the outer lid cannot relatively move in the axial direction and can relatively move in the circumferential direction; the outer lid is internally provided with a hollow thread part, an inner thread is arranged on the inner wall of the thread part, an outer thread is arranged on the outer wall of the inner core, the inner thread of the thread part matches with the outer thread of the inner core.

8 Claims, 10 Drawing Sheets

ROTARY SEALED PACKAGING CONTAINER

TECHNICAL FIELD

The present disclosure belongs to the field of packaging, and in particular relates to a rotary sealed packaging container.

BACKGROUND

Along with ever-growing consumption of food, drinks, drug and daily chemical products, there are higher and higher packaging requirements on each product. Especially for daily chemical products and food, the safety and sanitation should be guaranteed, the functions should meet the use requirements, additionally, the use should be simple, the structure should be fashioned, and the appearance should be attractive and high-grade, resulting in improving the grade and enhancing the market competitiveness.

Currently, the liquid outlet of a packaging container on the market is usually sealed externally, however, for some packaging containers such as sponge, brushes, rollers and the like, their openings are not suitable for being directly sealed externally. Therefore, the present disclosure provides a solution that the opening may be sealed internally and the liquid discharge amount may be shown by utilizing scale lines when the outer lid rotates to different angles.

SUMMARY

One technical problem to be solved by the present disclosure is to provided a rotary sealed packaging container in order to solve such problems that the liquid discharge amount of the packaging container in the prior art cannot be controlled and the packaging container cannot be sealed internally.

In order to solve the above technical problem, the present disclosure is implemented by the following technical schemes: a rotary sealed packaging container comprises an outer lid, a hollow inner core and a container body, wherein the inner core is mounted in an opening part of the container body in such a way that the inner core can relatively move in the axial direction of the container body and cannot relatively rotate in the circumferential direction of the container body, and the outer lid is mounted on the opening part of the container body in such a way that the outer lid cannot relatively move in the axial direction of the container and can relatively move in the circumferential direction of the container body; the outer lid is internally provided with a hollow thread part, an inner thread is arranged on the inner wall of the thread part, an outer thread is arranged on the outer wall of the inner core, the inner thread of the thread part matches with the outer thread of the inner core, a liquid outlet is opened on the top of the outer lid and is communicated with the thread part, an opening is correspondingly opened in the top of the inner core, a sealing part is arranged at the position corresponding to the liquid outlet of the top of the inner core, the outer lid rotates in the circumferential direction of the container body to drive the inner core to move up and down in the axial direction of the container body, and the sealing part correspondingly seals the liquid outlet or forms a gap from the liquid outlet while the inner core moves up and down.

Preferably, the first annular projection is formed on the outer edge of the opening part of the container body, the second annular projection is formed on the inner wall of the outer lid, and the second annular projection is rotatably clamped under the first annular projection in the circumferential direction of the container body.

Preferably, a guide groove is opened in the first annular projection, a guide post is arranged at the position corresponding to the guide groove under the second annular projection, and the guide post is inserted in the guide groove and can pass through the guide groove.

Preferably, at least one first stop part is arranged below the first annular projection, at least one second stop part is arranged below the second annular projection, the second annular projection rotates in the circumferential direction of the container body to drive the second stop part and the first stop part to be propped against each other or separated from each other.

Preferably, two first stop parts are symmetrically arranged below the first annular projection, and two second stop parts are symmetrically arranged below the second annular projection, so that the rotation angle of the second annular projection in the circumferential direction of the container body is in a range from 0 degree to 180 degrees.

Preferably, a transverse fixed rod is arranged on the opening part of the container body, a groove is opened on the bottom of the inner core in the axial direction of the container body, and the groove is movably sleeved on the periphery of the fixed rod in the axial direction of the container body.

Preferably, two stop points are symmetrically arranged at the top of the fixed rod, two toggle pieces are symmetrically arranged at the bottom of the thread part, and the thread part rotates along with the rotation of the outer lid and correspondingly drives the toggle pieces to cross the stop points and make a prompt tone.

Preferably, the packaging container further comprises a liquid discharge head, through which liquid may pass, and the liquid discharge head is mounted on the top of the outer lid and corresponds to the liquid outlet.

Preferably, the liquid discharge head is made of one selected from the group consisting of plastic, sponge, a ball, a smear, a brush, flocking, metal and ceramic.

Preferably, the packaging container further comprises an outer cover, a limiting projection is arranged on the outer wall of the outer lid, a limiting groove is formed in the inner wall of the outer cover, the outer cover covers the outer lid, and the limiting projection and the limiting groove are clamped with each other.

Compared with the prior art, the present disclosure has the following beneficial effects: the rotary sealed packaging container provided by the present disclosure comprises the outer lid, the hollow inner core and the container body, the inner core only can move in the axial direction of the container body, but cannot rotate relative to the circumferential direction of the container body, the outer lid only can rotate in the circumferential direction of the container body, but cannot move relative to the axial direction of the container body, and simultaneously the inner cover is in thread matching with the thread part in the outer lid, so, the outer lid rotates to drive the inner core through the thread part in the outer lid, the inner core moves up and down under the limiting action of the threads and the container body and then drives the sealing part at the top of the inner core to seal the liquid outlet at the top of the outer lid or to form a gap from the liquid outlet, thereby achieving functions of opening the liquid outlet and closing the liquid outlet. The packaging container utilizes the inner core in the container body to achieve the opening and the closing of the liquid outlet, so that the packaging container is convenient to use and is hard to be broken in comparison with the packaging container, in which the liquid outlet is sealed externally, in the prior. Furthermore, the distance between the sealing part at the top of the inner core and the liquid outlet of the outer lid can be regulated by regulating the rotation angle of the outer lid so as to control the liquid discharge amount in order to meet different use requirements of different customers.

DESCRIPTION OF THE EMBODIMENTS

To make the purposes, technical schemes, and advantages of the present disclosure clearer, the following further describes the present disclosure in detail in conjunction with accompanying drawings and embodiments. It should be understood that the described exemplary embodiments are only used for illustrating the present disclosure, but not intent to limit the present disclosure.

Figure 1:
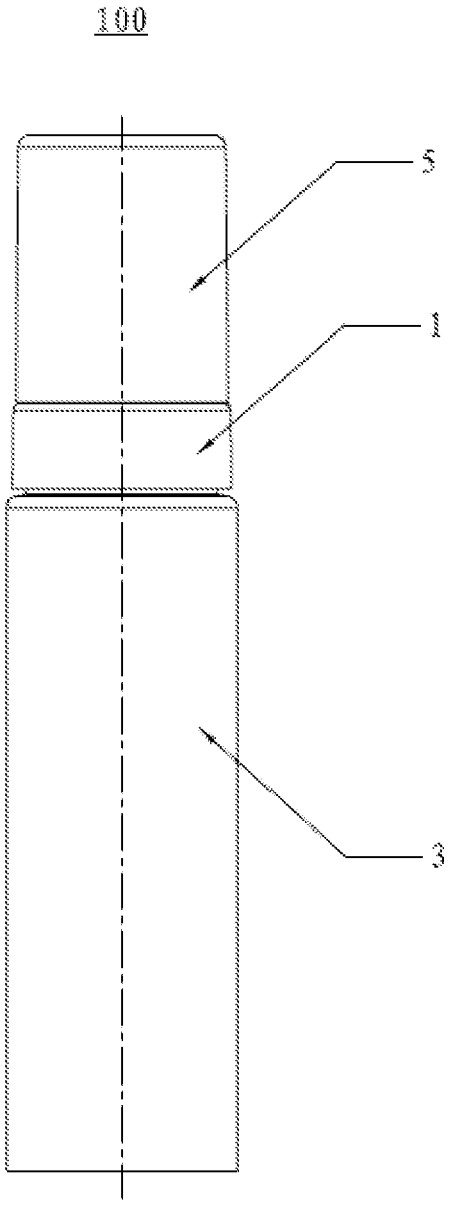
FIG. 1 is a schematic diagram of an integral structure of a rotary sealed packaging container provided by one embodiment of the present disclosure.
Figure 2:
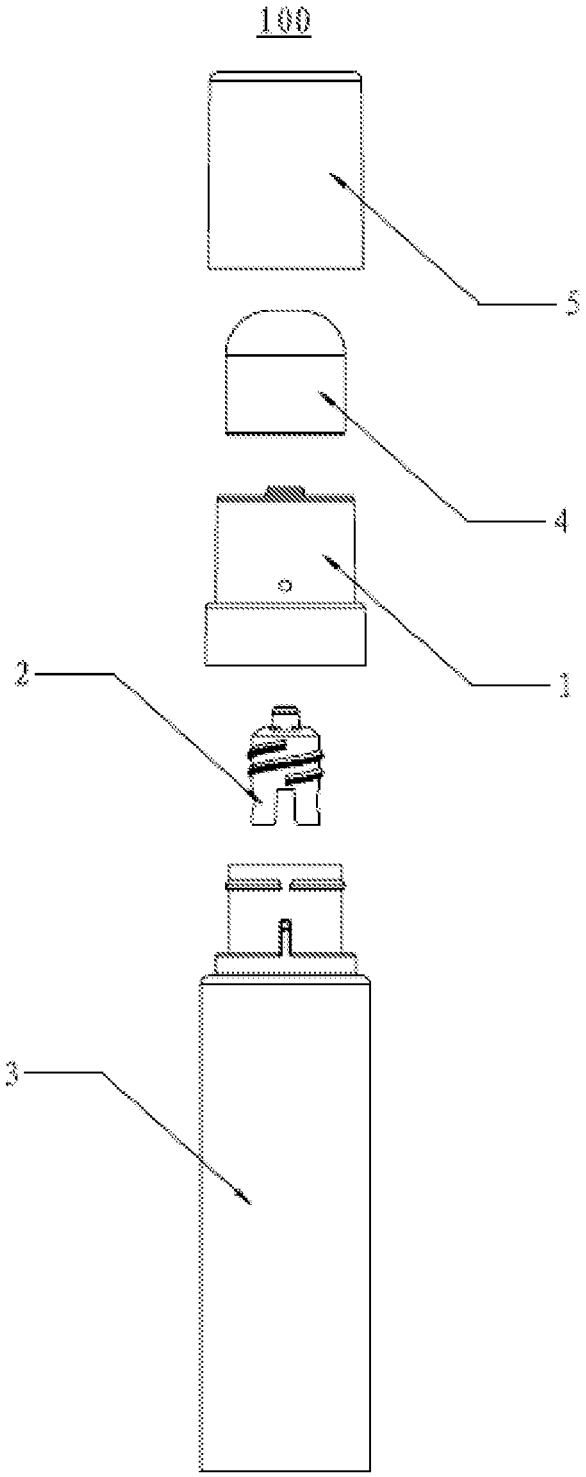
FIG. 2 is a schematic diagram of a disassembled structure of FIG. 1.
Figure 3:
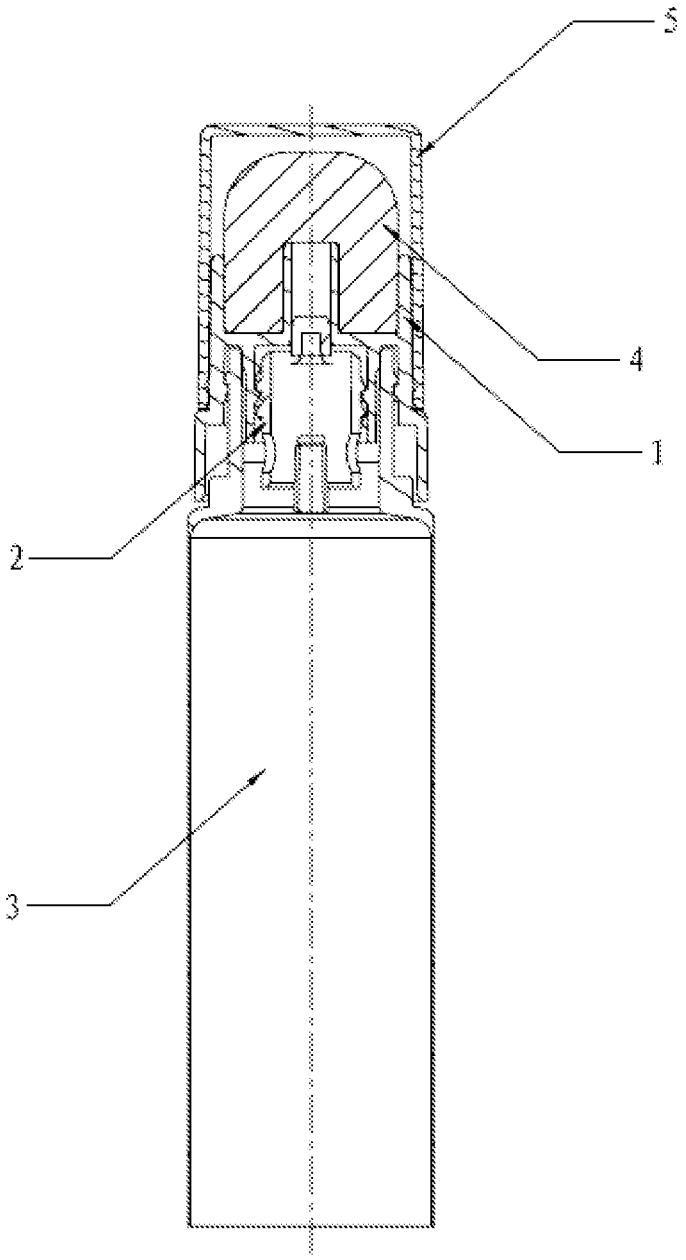
FIG. 3 is a schematic diagram of a sectional structure of FIG. 1.

As shown in FIG. 1 and FIG. 2, a rotary sealed packaging container 100 provided by embodiments of the present disclosure comprises an outer lid 1, a hollow inner core 2, a container body 3, a liquid discharge head 4 and an outer cover 5.

Specifically, referring to FIG. 3 to FIG. 7, a transverse fixed rod 31 is arranged in an opening part of the container body 3, a groove 21 is opened in the bottom of the inner core 2 in the axial direction of the container body 3, and the groove 21 is movably sleeved on the periphery of the fixed rod 31 in the axial direction of the container body 3, so that the inner core 2 can move in the axial direction of the container body 3, and meanwhile, the inner core 2 cannot relatively rotate in the axial direction of the container body 3 due to the limiting function of the fixed rod 31. The inner core 2 and the container body 3 certainly are not limited to such connection manner in the embodiments, and can also be connected in other manners to ensure that they can axially move but cannot circumferentially rotate, for example, a vertical projection is arranged on the inner wall of the opening part of the container body 3 in the axial direction of the container body 3, and a vertical groove is formed in the outer wall of the inner core 2, so, the inner core 2 can only move up and down along the projection, and due to the limiting function of the projection and the groove, the inner core 2 cannot rotate.

Figure 8:
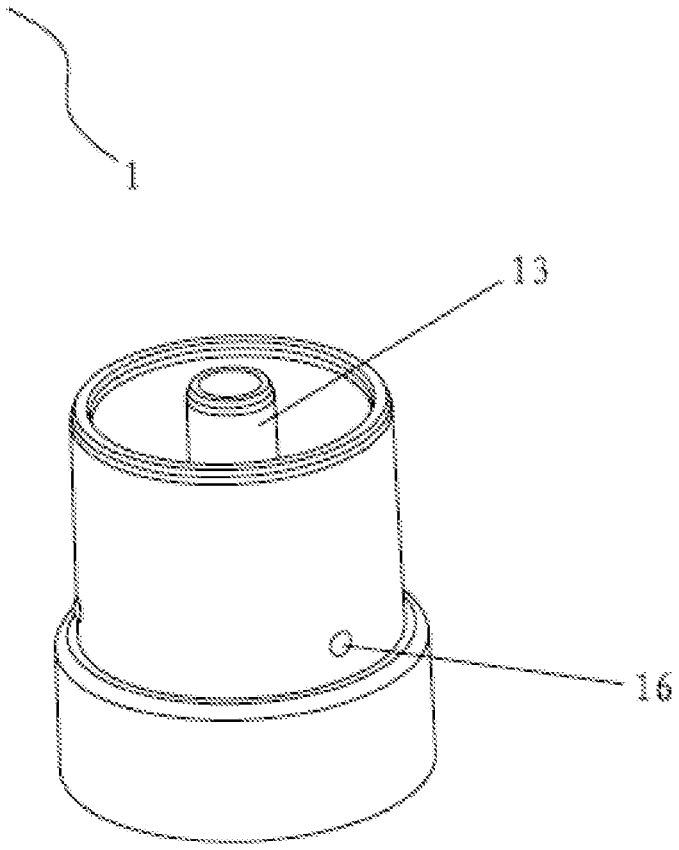
FIG. 8 is a schematic diagram of a three-dimensional structure of the outer lid in FIG. 2.
Figure 9:
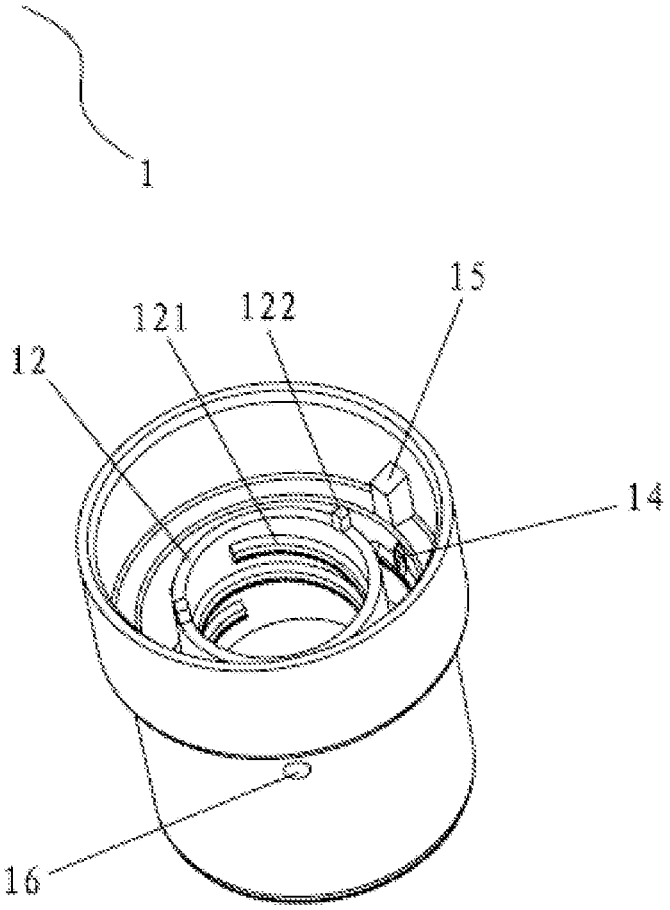
FIG. 9 is a structural schematic diagram of FIG. 8 from another perspective view.
Figure 10:
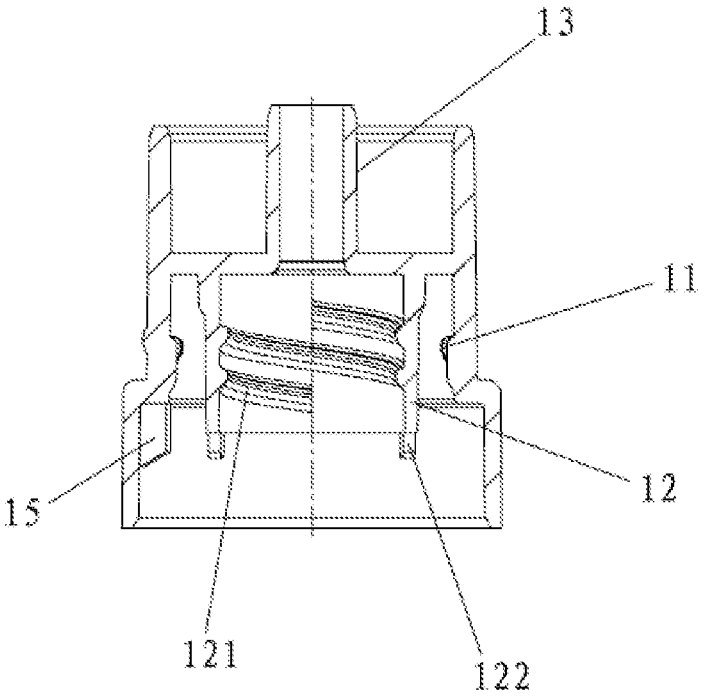
FIG. 10 is a schematic diagram of a sectional structure of FIG. 8.

Referring to FIG. 8 to FIG. 10, the first annular projection 32 is arranged at the outer edge of the opening part of the container body 3, the second annular projection 11 is arranged on the inner wall of the outer lid 1, and the second annular projection 11 is rotatably clamped under the first annular projection 32 in the circumferential direction of the container body 3, so that the outer lid 1 can rotate in the circumferential direction of the container body 3, and simultaneously due to the limiting function of the first annular projection 32 and the second annular projection 11, the outer lid 1 cannot relatively move in the axial direction of the container body 3 while rotating.

A hollow thread part 12 is arranged in the outer lid 1, an inner thread 121 is arranged on the inner wall of the thread part 12, and an outer thread 22 is arranged on the outer wall of the inner core 2, so, the inner thread 121 on the thread part 12 matches with the outer thread 22 on the inner core 2 when the outer lid 1 is mounted on the container body 3. A liquid outlet 13 is opened on the top of the outer lid 1 and is communicated with the thread part 12, openings 23 are correspondingly opened on the top of the inner core 2, and a sealing part 24 is formed at a position corresponding to the liquid outlet 13 of the top of the inner core 2.

The outer lid 1 rotates in the circumferential direction of the container body 3 to drive the inner core 2 to move up and down in the axial direction of the container body 3, and when the inner core 2 moves up and down, the sealing part 24 correspondingly seals the liquid outlet 13 or is separated from the liquid outlet 13 so as to internally open or close the liquid outlet 13. Besides, the distance between the sealing part 24 and the liquid outlet 13 can be regulated by regulating a rotation angle of the outer lid 1 so that the liquid discharge amount can be regulated to meet various requirements of different customers.

In one embodiment of the present disclosure, a guide groove 321 is opened in the first annular projection 32, a guide post 14 is arranged at a position corresponding to the guide groove 321 under the second annular projection 11, and the guide post 14 is inserted in the guide groove 321 and can pass through the guide groove 321. When the outer lid 1 and the container body 3 are assembled, the guide post 14 is firstly inserted in the guide groove 321 in order to initially limit and guide the outer lid 1, and then the outer lid 1 is pressed to a place which ensures that the second annular projection 11 is located under the first annular projection 32. When the outer lid 1 is pressed to the right position, the thread part 12 correspondingly matches with the inner core 2 via threads.

At least one first stop part 33 is arranged below the first annular projection 32, at least one second stop part 15 is arranged below the second annular projection 11, the second annular projection 11 rotates in the circumferential direction of the container body 3 to drive the second stop part 15 and the first stop part 33 to be propped against each other or separated from each other, so, when the sealing part 24 on the inner core 2 seals the liquid outlet 13 of the outer lid 1, the second stop part 15 and the first stop part 33 are propped against each other, thereby preventing the inner core 2 or the outer lid 1 from being damaged caused by overexertion of the customer. In the above embodiment, two first stop parts 33 are symmetrically arranged below the first annular projection 32, and two second stop parts 15 are symmetrically arranged below the second annular projection 11, so that the rotation angle of the second annular projection 11 in the circumferential direction of the container body 3 is in a range from 0 degree to 180 degrees, and the number of the first stop parts 33 and the number of the second stop parts 15 can also be set to three or more according to actual requirements.

Figure 6:
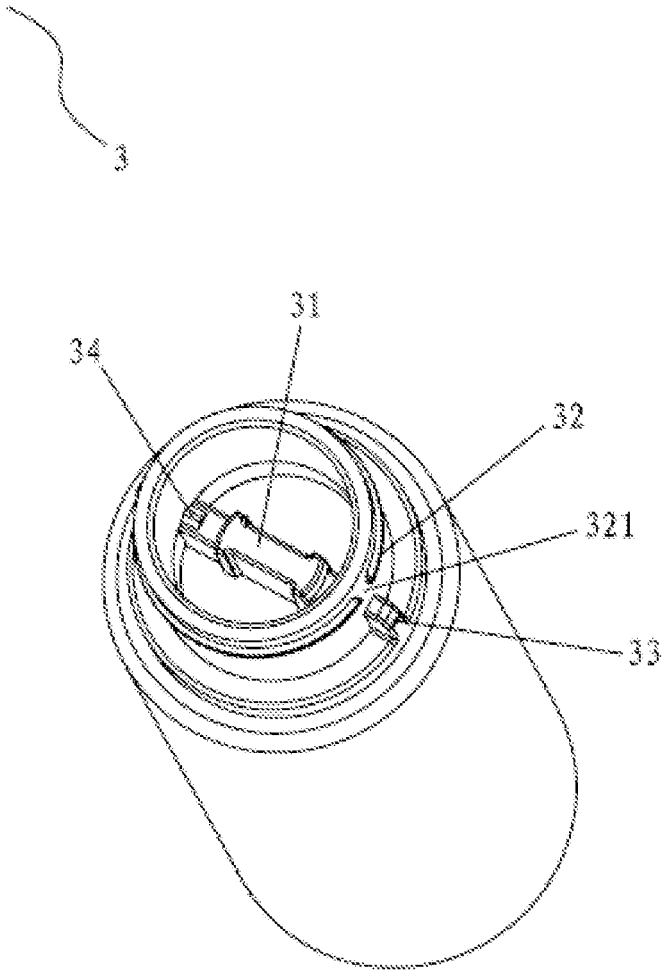
FIG. 6 is a schematic diagram of a three-dimensional structure of the container body in FIG. 2.
Figure 7:
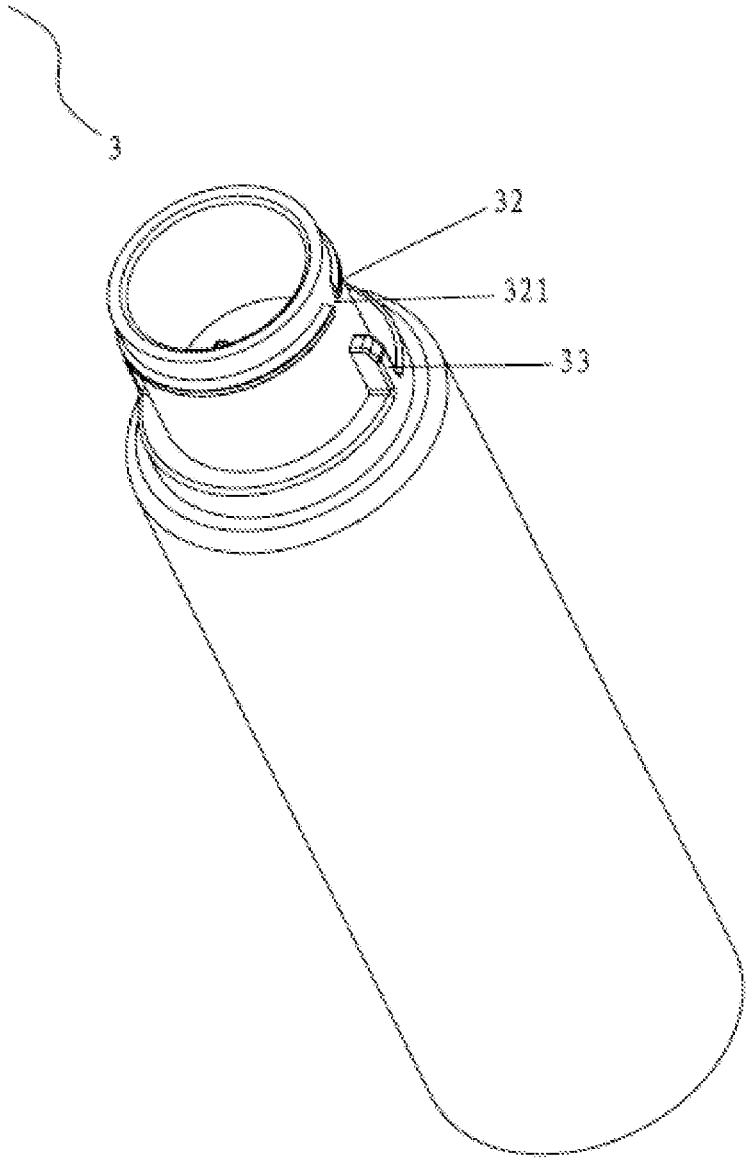
FIG. 7 is a structural schematic diagram of FIG. 6 from another perspective view.

Referring to FIG. 6, two stop points 34 are symmetrically arranged at the top of the fixed rod 31, two toggle pieces 122 are symmetrically arranged at the bottom of the thread part 12, and the thread part 12 rotates along with the rotation of the outer lid 1 and correspondingly drives the toggle pieces 122 to cross the stop points 34 and make a sound of click. When the customer rotates the outer lid 1 clockwise and hears the sound of click, it represents that the sealing part 24 of the inner core 2 seals the liquid outlet 13 of the outer lid 1; and when the customer rotates the outer lid 1 anticlockwise and hears the sound of click, it represents that the sealing part 24 of the inner core 2 is separated from the liquid outlet 13 of the outer lid 1 in the maximum distance and the liquid outlet 13 is opened.

Figure 4:
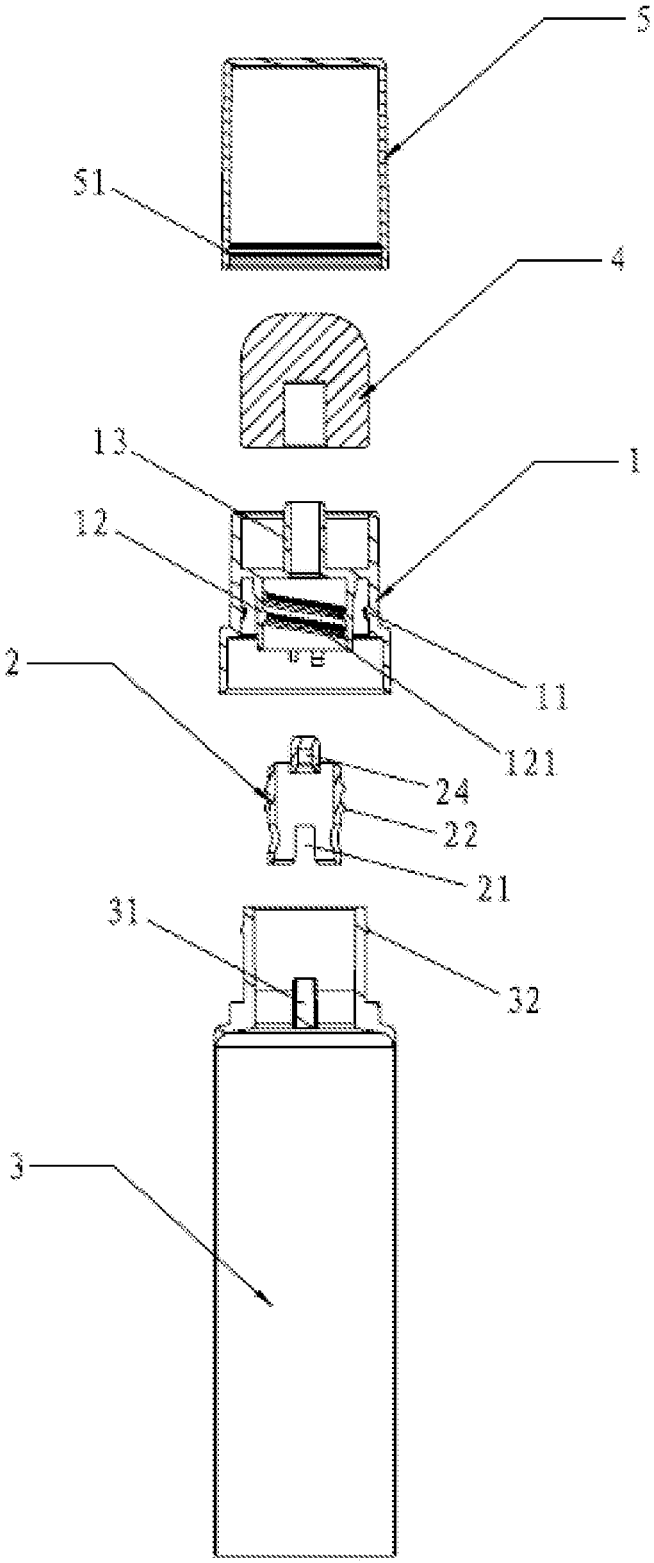
FIG. 4 is a schematic diagram of a sectional structure of FIG. 2.
Figure 5:
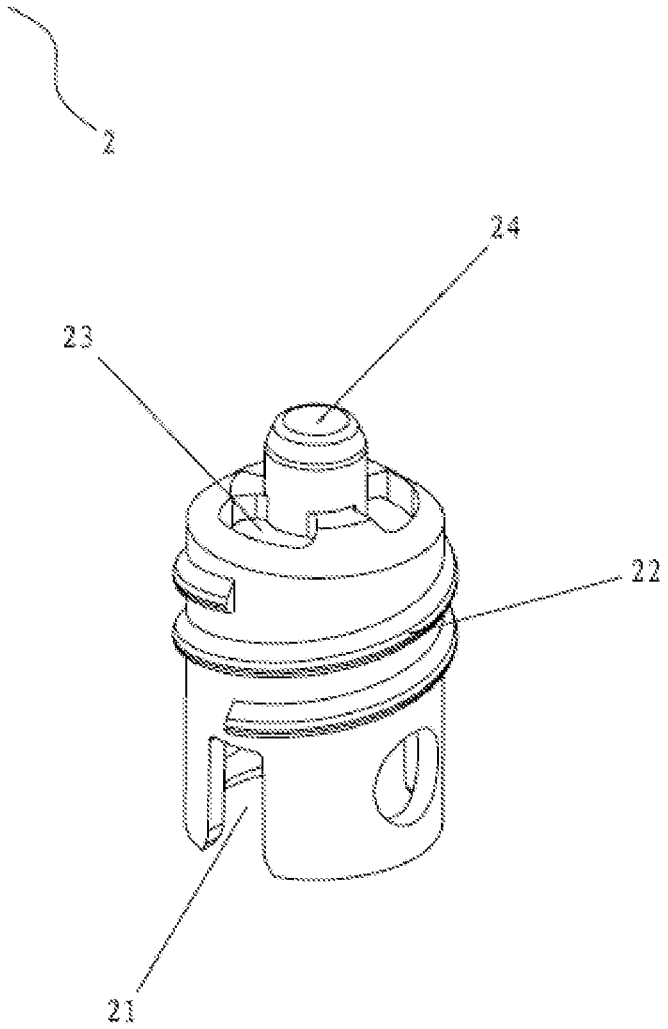
FIG. 5 is a schematic diagram of a three-dimensional structure of the inner core in FIG. 2.
Figure 11:
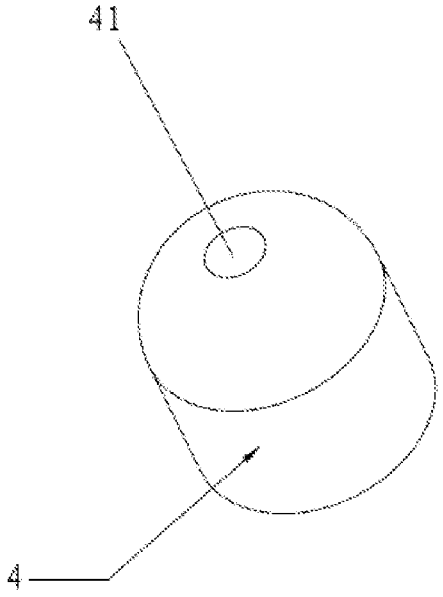
FIG. 11 is a schematic diagram of a three-dimensional structure of the liquid discharge head in FIG. 2.

The liquid discharge head 4 is mounted at the top of the outer lid 1, corresponds to the liquid outlet 13 and is used for allowing the passing of liquid. In the embodiments of the present disclosure, the liquid outlet 13 at the top of the outer lid 1 is a protruded column with a liquid discharge channel, as shown in FIG. 4 and FIG. 11, the liquid discharge head 4 covers the protruded column in order to protect the liquid outlet 13, and an opening 41 is opened in the liquid discharge head 4 and is communicated with the liquid discharge channel; and the liquid discharge head 4 is made of one selected from the group consisting of plastic, sponge, a ball, a smear, a brush, flocking, metal and ceramic, and the specific structure forms and the specific materials of the liquid discharge head 4 and the liquid outlet 13 in the embodiments of the present disclosure are not limited. Additionally, a limiting projection 16 is arranged on the outer wall of the outer lid 1, a limiting groove 51 is formed in the inner wall of the outer cover 5, the outer cover 5 covers the outer lid 1, and the limiting projection 16 and the limiting groove 51 are clamped. The whole outer lid 1 is protected by the outer cover 5, and meanwhile, the outer cover 5 prevents dusts from entering the liquid discharge head 4.

In the specific mounting process, firstly the inner core 2 is sleeved on the periphery of the fixed rod 31 so that the relative position of the inner core 2 is fixed, secondly the guide post 14 of the outer lid 1 is inserted into the guide groove 321 of the container body 3 so as to achieve alignment and guide, and then the second annular projection 11 of the outer lid 1 is gradually pressed till it is located under the first annular projection 32 of the container body 3. Because the alignment and the guide are achieved before the second annular projection 11 is pressed to be under the first annular projection 32, the outer thread 22 of the inner core 2 is partially combined with the inner thread 121 on the thread part 12 while the second annular projection 11 is pressed to be under the first annular projection 32.

After the mounting process is complete, the outer lid 1 is rotated clockwise so that the thread part 12 in the outer lid 1 drives the inner core 2 to move upwards till the sealing part 24 seals the liquid outlet 13, at this time, the second stop part 15 and the first stop part 33 are propped against each other, and when the outer lid 1 opens and is located at the right position, the toggle pieces 122 of the outer lid 1 and the stop points 34 on the container body 3 can make the sound of click to prompt the customer that the outer lid 1 rotates to the right position.

In conclusion, the rotary sealed packaging container 100 provided by the embodiments of the present disclosure utilizes the inner core 2 in the container body 3 to achieve the functions of opening the liquid outlet 13 and closing the liquid outlet 13, so that the rotary sealed packaging container 100 is convenient to use and is hard to be broken. Furthermore, the distance between the sealing part 24 at the top of the inner core 2 and the liquid outlet 13 of the outer lid 1 can be regulated by regulating the rotation angle of the outer lid 1, thereby controlling the liquid discharge amount in order to meet different use requirements of the different customers.

The foregoing descriptions are merely exemplary embodiments of the present disclosure, and the protection scope of the present disclosure is not limited thereto. Any modification, equivalent replacement and improvement made within the idea and principle of the present disclosure should fall within the protection scope of the present disclosure.

What is claimed is:

1. A rotary sealed packaging container comprising an outer lid, a hollow inner core and a container body, wherein the inner core is mounted in an opening part of the container body in such a way that the inner core can relatively move in the axial direction of the container body but cannot relatively rotate in the circumferential direction of the container body, and the outer lid is mounted on the opening part of the container body in such a way that the outer lid cannot relatively move in the axial direction of the container and can relatively move in the circumferential direction of the container body; the outer lid is internally provided with a hollow thread part, an inner thread is arranged on the inner wall of the hollow thread part, an outer thread is arranged on the outer wall of the inner core, the inner thread of the hollow thread part matches with the outer thread of the inner core, a liquid outlet is opened on the top of the outer lid and is communicated with the hollow thread part, an opening is correspondingly opened on the top of the inner core, a sealing part is arranged at the position corresponding to the liquid outlet of the top of the inner core, the outer lid rotates in the circumferential direction of the container body to drive the inner core to move up and down in the axial direction of the container body, and the sealing part correspondingly seals the liquid outlet or forms a gap from the liquid outlet while the inner core moves up and down;

a first annular projection is formed on the outer edge of the opening part of the container body, a second annular projection is formed on the inner wall of the outer lid, and the second annular projection is rotatably clamped under the first annular projection in the circumferential direction of the container body;

a guide groove is opened in the first annular projection, a guide post is arranged at the position corresponding to the guide groove under the second annular projection, and the guide post is inserted into the guide groove and passes through the guide groove.

2. The rotary sealed packaging container of claim 1, wherein at least one first stop part is arranged below the first annular projection, at least one second stop part is arranged below the second annular projection, the second annular projection rotates in the circumferential direction of the container body to drive the second stop part and the first stop part to be propped against each other or separated from each other.

3. The rotary sealed packaging container of claim 2, wherein two first stop parts are symmetrically arranged below the first annular projection, two second stop parts are symmetrically arranged below the second annular projection, and the rotation angle of the second annular projection in the circumferential direction of the container body is in a range from 0 degree to 180 degrees.

4. The rotary sealed packaging container of claim 1, wherein a transverse fixed rod is arranged on the opening part of the container body, a groove is opened on the bottom of the inner core in the axial direction of the container body, and the groove is movably sleeved on the periphery of the fixed rod in the axial direction of the container body.

5. The rotary sealed packaging container of claim 4, wherein two stop points are symmetrically arranged at the top of the fixed rod, two toggle pieces are symmetrically arranged at the bottom of the hollow thread part, and the hollow thread part rotates along with the rotation of the outer lid and correspondingly drives the toggle pieces to cross the stop points and make a prompt tone.

6. The rotary sealed packaging container of claim 1, wherein the packaging container further comprises a liquid discharge head through which liquid may pass, and the liquid discharge head is mounted on the top of the outer lid and corresponds to the liquid outlet.

7. The rotary sealed packaging container of claim 6, wherein the liquid discharge head is made of one selected from the group consisting of plastic, sponge, a ball, a smear, a brush, flocking, metal and ceramic.

8. The rotary sealed packaging container of claim 1, wherein the packaging container further comprises an outer cover, a limiting projection is arranged on the outer wall of the outer lid, a limiting groove is formed in the inner wall of the outer cover, the outer cover covers the outer lid, and the limiting projection and the limiting groove are clamped with each other.

* * * * *